US006576388B2

(12) United States Patent
Sakon et al.

(10) Patent No.: US 6,576,388 B2
(45) Date of Patent: Jun. 10, 2003

(54) MULTILAYER ELECTROPHOTOGRAPHIC PHOTORECEPTOR, AND IMAGE FORMING METHOD, IMAGE FORMING APPARATUS AND PROCESS CARTRIDGE USING THE PHOTORECEPTOR

(75) Inventors: Yohta Sakon, Numazu (JP); Akio Kosuge, Yokohama (JP); Tatsuya Niimi, Numazu (JP); Narihito Kojima, Numazu (JP)

(73) Assignee: Ricoh Company Limited, Tokyo (JP)

( * ) Notice: Subject to any disclaimer, the term of this patent is extended or adjusted under 35 U.S.C. 154(b) by 6 days.

(21) Appl. No.: 09/985,368

(22) Filed: Nov. 2, 2001

(65) Prior Publication Data

US 2002/0197549 A1 Dec. 26, 2002

(30) Foreign Application Priority Data

| | | |
|---|---|---|
| Nov. 10, 2000 | (JP) | 2000-342999 |
| Apr. 4, 2001 | (JP) | 2001-105675 |
| Oct. 4, 2001 | (JP) | 2001-308556 |

(51) Int. Cl.[7] ..... G03G 5/14
(52) U.S. Cl. ..... 430/67; 430/126
(58) Field of Search ..... 430/66, 126, 67

(56) References Cited

U.S. PATENT DOCUMENTS

| | | | | |
|---|---|---|---|---|
| 5,547,790 | A | 8/1996 | Umeda et al. | |
| 5,677,094 | A | 10/1997 | Umeda et al. | |
| 5,693,443 | A * | 12/1997 | Nakamura et al. | 430/66 |
| 5,695,898 | A * | 12/1997 | Go et al. | 430/66 |
| 5,804,343 | A | 9/1998 | Umeda et al. | |
| 5,853,935 | A | 12/1998 | Suzuki et al. | |
| 5,871,876 | A | 2/1999 | Ikuno et al. | |
| 6,030,733 | A | 2/2000 | Kami et al. | |
| 6,087,055 | A | 7/2000 | Niimi | |
| 6,132,911 | A | 10/2000 | Niimi | |
| 6,218,533 | B1 | 4/2001 | Niimi | |
| 6,326,112 | B1 * | 12/2001 | Tamura et al. | 430/58.7 |

FOREIGN PATENT DOCUMENTS

| | | |
|---|---|---|
| JP | 53133444 | 11/1978 |
| JP | 55157748 | 12/1980 |
| JP | 57030846 | 2/1982 |
| JP | 02004275 | 1/1990 |
| JP | 04281461 | 10/1992 |
| JP | 08234455 | 9/1996 |
| JP | 08339092 | 12/1996 |

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic photoreceptor including at least an electroconductive substrate; and a photosensitive layer overlying the electroconductive substrate and including at least a charge generation layer; a charge transport layer; and a protective layer including a filler, wherein the filler is dispersed in the protective layer so as to occupy an area of from 3 to 5% of a cross section of the protective layer; the filler has particle diameter distribution having a peak at a diameter of from 0.2 to 0.3 $\mu$m; and the particles of the filler having a particle diameter of not less than 0.3 $\mu$m occupies an area of from 10 to 30% of the area of all the filler in the cross section of the protective layer.

24 Claims, 3 Drawing Sheets

MULTILAYER ELECTROPHOTOGRAPHIC PHOTORECEPTOR, AND IMAGE FORMING METHOD, IMAGE FORMING APPARATUS AND PROCESS CARTRIDGE USING THE PHOTORECEPTOR

BACKGROUND OF THE INVENTION

1. Field of the Invention

The present invention relates to a multilayer electrophotographic photoreceptor, and to an image forming method, an image forming apparatus and a process cartridge for an image forming apparatus using the photoreceptor.

2. Discussion of the Background

Electrophotographic methods such as the Carlson process and its various modified processes are widely used for copiers, printers, etc. As an electrophotographic photoreceptor (hereinafter referred to as a photoreceptor) for use in the electrophotographic method, an organic photoreceptor has been typically used because of its low cost, the ease of mass producing it, and because it is non-polluting. A mechanism of forming an electrostatic latent image on a photoreceptor include:

(1) irradiating a photoreceptor after it has been charged;

(2) the irradiated light is then absorbed in a charge generation material of the photoreceptor;

(3) the light-absorbed charge generation material generates a charge carrier;

(4) the charge carrier is injected into a charge transport material and transported through the charge transport layer (or the photosensitive layer) along an electric field generated by the charge; and (5) the charge carrier neutralizes the charge on the surface of the photoreceptor to form an electrostatic latent image.

Specific examples of organic photoreceptors include the following photosensitive layers:

(1) photoconductive resin layers typified by polyvinylcarbazole (PVK);

(2) charge transfer complex type photosensitive layers typified by 2,4,7-trinitrofluorenon (PVK-TNF);

(3) pigment dispersion type photosensitive layers typified by phthalocyanine-binder; and (4) functionally-separated photosensitive layers using a combination of a charge generation material and a charge transport material.

Among these photoreceptors, the functionally-separated photoreceptors have attracted attention and come into practical use.

Various organic photoreceptors have been developed. However, in order to make a good photoreceptor requires good electrophotographic properties such as high sensitivity, high potential, high potential retainability, good potential stability, low residual potential and proper spectral properties; good mechanical durability such as high abrasion resistance; good chemical stability against heat, light and discharge-induced products (e.g. ozone and Nox), etc.

Above all, a need exists for a photoreceptor having a small diameter because there is a demand for downsizing electrophotographic systems. Therefore, there is a demand for a photoreceptor having good durability against abrasion increasing in proportion to the number of copies.

Thus, mechanical durability, which typically means abrasion resistance, is in strong demand. However, the conventional organic photoreceptors and the electrophotographic processes using these photoreceptors do not have high durability due to the low abrasion resistance of the organic materials used. In addition, the demand for a photoreceptor having good abrasion resistance has increased because the thickness of a photosensitive layer has to be decreased so as to produce higher definition images.

The reason why the thickness of a photosensitive layer has a particularly big influence on producing higher definition images is considered as follows.

Among positive and negative carriers formed in the charge generation layer of a negatively chargeable multilayer organic photoreceptor by light irradiation, the negative carrier (an electron) is absorbed in the substrate and the positive carrier (a hole) is transported through the charge transport layer to the surface of the photoreceptor to be combined with an electron thereat, resulting in disappearance of the hole.

Due to the disappearance, the electric field to attract the hole gradually decreases, and the hole moves toward a non-lighted area.

This is called a carrier scattering phenomenon in a direction of the surface of the photoreceptor, and because of it formation of a latent image faithful to the irradiated light is prevented. This results in formation of a poor image having low resolution.

The thickness of the charge transport layer has a big influence on the carrier scattering phenomenon, and making the thickness smaller is very effective relative to maintaining good image resolution.

In addition, laser irradiation is different from irradiation by a halogen lamp, etc. because the incident photon current speed of a laser is about $10^7$ times as fast as that of a halogen lamp. Therefore, the density of the formed carriers is extremely high, and the electric field strength of the charge generation layer decreases because charges flow into the charge transport layer. Thus, the carrier transport speed is influenced, resulting in late arrival of the carrier formed by irradiation of the center portion of the laser beam to the surface of the photoreceptor. The thus formed space charge distribution tends to cause carrier scattering in a direction parallel to the surface of the photoreceptor, resulting in deterioration of image resolution.

Japanese Laid-Open Patent Publication No. 57-30846 discloses a method for improving abrasion resistance of an organic photoreceptor, which includes a protective layer including a filler formed from a metal or a metal oxide. The object of this method is to increase the transparency of the protective layer and prevent an increase of residual potential by using a filler having an average particle diameter of not greater than 0.3 $\mu$m. In addition, Japanese Laid-Open Patent Publication No. 4-281461 discloses a method, in which a charge transport material is included in a protective layer together with a filler to prevent an increase of residual potential while maintaining good abrasion resistance. Japanese Laid-Open Patent Publications Nos. 53-133444 and 55-157748 disclose a method, in which an organic acid is included in a protective layer together with a filler, and Japanese Laid-Open Patent Publication No. 2-4275 discloses a method, in which an electron accepting material is included in a protective layer, to prevent an increase of residual potential. Japanese Laid-Open Patent Publication No. 8-234455 discloses a method, in which the difference in refractive index between a filler in a charge transport layer and the charge transport layer is not less than 0.1, and the layer includes $1\times10^4$ to $2\times10^5$ pieces of filler particles having a particle diameter of from 1 to 3 $\mu$m per 1 $\mu m^2$.

Further, Japanese Laid-Open Patent Publication No. 8-339092 discloses a method, in which a surface layer of a photoreceptor includes inorganic particles having a volume average particle diameter of from 1 μm to 2 μm and a ratio of the number average particle diameter to the weight average particle diameter of from 1 to 2.

However, although the photoreceptors produced by these methods have good abrasion resistance, these photoreceptors have the following drawbacks:

(1) toner film tends to be formed thereon;

(2) the surface thereof is poorly cleaned because contact of a cleaning blade with the photoreceptors deteriorates due to agglomeration of a filler in the protective layer which is caused by poor dispersion of the filler; and (3) the electrostatic stability and durability of a the photoreceptor deteriorate.

Therefore, the desired photoreceptor properties have not been achieved yet. Particle conditions of inorganic particles included in a protective layer have a big influence on the above-mentioned properties of the resultant photoreceptor. This is partly disclosed in Japanese Laid-Open Patent Publication No. 8-339092. However, the actual particle conditions of the inorganic particles in the protective layer are not described therein. Instead, it is only described that the particle diameter distribution in a dispersion liquid is sharp and large particles are not included therein. Therefore, a photoreceptor having good electrophotographic properties and good durability has not been developed yet.

SUMMARY OF THE INVENTION

Accordingly, an object of the present invention is to provide an electrophotographic photoreceptor which can be used for a high-durability and high-speed digital electrophotographic image forming apparatus using a laser as a writing light source, and which can produce a high resolution image by the laser irradiation.

Another object of the present invention is to provide a photoreceptor which has high mechanical durability while having a thin layer to produce a high-resolution image.

Yet another object of the present invention is to provide an image forming method, an image forming apparatus and a process cartridge for an image forming apparatus using the photoreceptor, by which images having good image qualities can be produced for a long period of time without producing an abnormal image such as image tailing which is produced by a conventional high-abrasion-resistance photoreceptor.

A further object of the present invention is to provide a photoreceptor having a surface layer which is abraded in a very small amount to remove surface-deteriorating substances adhered on the surface layer, and to provide an image forming apparatus and method including a cleaner cleaning the deteriorating substances. It cannot be said that a photoreceptor having the highest possible abrasion resistance is always good. It is, instead, preferable that the surface of a photoreceptor is abraded in a very small amount by removing surface-deteriorating substances to keep the surface of the photoreceptor clean.

Briefly these objects and other objects of the present invention as hereinafter will become more readily apparent can be attained by a photoreceptor including at least an electroconductive substrate; and a photosensitive layer overlying the electroconductive substrate and including at least a charge generation layer; a charge transport layer; and a protective layer including a filler, wherein the filler is dispersed in the protective layer so as to occupy an area of from 3 to 5% of a cross section of the protective layer; the filler has a particle diameter distribution having a peak at a diameter of from 0.2 to 0.3 μm; and the particles of the filler having a particle diameter of not less than 0.3 μm occupies an area of from 10 to 30% of the area of all the filler in the cross section of the protective layer.

In another aspect of the present invention, an image forming method using the photoreceptor is provided.

In yet another aspect of the present invention, an image forming apparatus using the photoreceptor is provided.

In a further aspect of the present invention, a process cartridge using the photoreceptor is provided.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
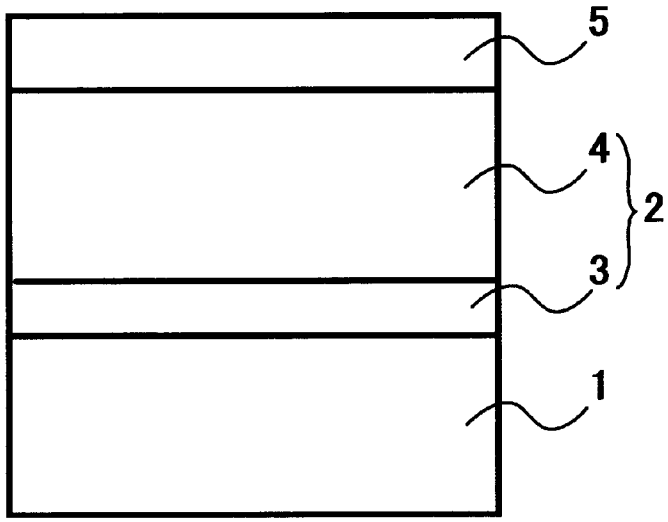
FIG. 1 is a schematic cross-sectional view of an embodiment of the multilayer electrophotographic photoreceptor of the present invention.
Figure 2:
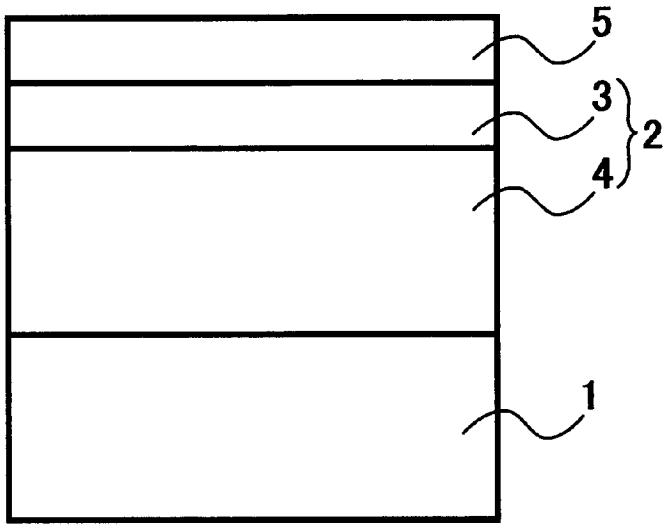
FIG. 2 is a schematic cross-sectional view of another embodiment of the multilayer electrophotographic photoreceptor of the present invention.

Generally, the present invention provides an electrophotographic photoreceptor including a charge generation layer 3 formed from a charge generation material, charge transport layer 4 formed from a charge transport material and a protective layer 5. The protective layer 5 will be explained later.

An electroconductive substrate 1 is provided as a plastic film, a plastic cylinder or a paper coated with a material having a volume resistance of not greater than $10^{10}$ Ω·cm, for example, metals such as aluminium, nickel, chromium, nichrome, copper, silver, gold and platinum, and metal oxides such as tin oxides and indium oxides can be coated by deposition or sputtering. In addition, a plate of metal such as aluminium, aluminium alloys, nickel and stainless steel can be used. Tubes formed by tubing such metal plates also can be used, the surface of which is treated by cutting, super finishing and polishing.

The charge generation layer 3 is formed from a charge generation material.

An inorganic or an organic material is used as a charge generation material. Specific examples of the charge generation materials include mono azo pigments, disazo pigments, trisazo pigments, perylene pigments, perynone pigments, quinacridone pigments, quinone type condensed polycyclic compounds, squaric acid type dyes, phthalocyanine type pigments, naphthalocyanine type pigments, azulenium salt type dyes, selenium, selenium-tellurium alloys, selenium-arsenic alloys, and amorphous-silicon. These charge generation materials can be used alone or in combination.

The charge generation layer 3 can be formed by the following method:

(1) the charge generation material is mixed with a solvent such as tetrahydrofuran, cyclohexane, dioxane, 2-butanone and dichloroethane optionally together with a binder resin;

(2) the mixture is dispersed with a ball mill, an attritor or a sand mill to prepare a coating liquid; and (3) the coating liquid is coated on the electroconductive substrate to form a charge generation layer.

The coating liquid can be coated by a coating method such as dip coating, spray coating and bead coating.

Specific examples of the binder resins optionally used include polyamide resins, polyurethane resins, polyester resins, epoxy resins, polyketone resins, polycarbonate resins, silicone resins, acryl resins, polyvinyl butyral resins, polyvinyl formal resins, polyvinyl ketone resins, polystyrene resins, and polyacryl resins. The suitable content of the binder resin is from 0 to 200 parts by weight per 100 parts by weight of the charge generation material.

The charge generation layer 3 can also be formed by known vacuum thin film forming methods. The thickness of the charge generation layer 3 is typically from 0.01 to 5 $\mu$m, and preferably from 0.1 to 2 $\mu$m.

The charge transport layer 4 can be formed by the following method:

(1) a charge transport material and a binder resin are dissolved or dispersed in a suitable solvent to prepare a charge transport coating liquid; and (2) the coating liquid is coated on the substrate and dried to form a charge transport material.

A plasticizer, a leveling agent, etc, can be optionally added to the coating liquid.

Low molecular weight charge transport materials in the charge transport materials include an electron transport material and a positive-hole transport material. Specific examples of the electron transport materials include electron-accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one and 1,3,7-trinitrodibenzothiophene-5,5-dioxides.

These electron transport materials can be used alone or in combination.

Specific examples of the positive-hole transport materials include electron-releasing materials such as oxazole derivatives, oxadiazole derivatives, imidazole derivatives, triphenylamine derivatives, 9-(p-diethylaminostyrylanthracene), 1,1-bis-(4-dibenzilaminophenyl)propane, styrylanthracene, styrylpyrazoline, phenylhydrazone, $\alpha$-phenylstilbene derivatives, thiazole derivatives, triazole derivatives, phenazine derivatives, acridine derivatives, benzofuran derivatives, benzimidazole derivatives and thiophene derivatives.

These positive-hole transport materials can be used alone or in combination.

When a high molecular weight charge transport material is used, a charge transport layer can be formed by dissolving or dispersing the material in a suitable solvent to prepare a coating liquid, which is coated on the substrate and dried. The high molecular weight charge transport material may be the above-mentioned low molecular weight charge transport material having a charge transport substituent in the main chain or in the side chain.

In addition, a binder resin, a low molecular weight charge transport material, a plasticizer, a lubricant and the like can be added to the high molecular weight charge transport material.

Specific examples of the binder resins for use in the charge transport layer 4 together with the charge transport material include thermoplastic or thermosetting resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, acrylic resins, silicone resins, epoxy resins, melamine resins, urethane resins, phenol resins and alkyd resins.

Specific examples of the solvents include tetrahydrofuran, dioxane, toluene, 2-butanone, monochlorobenzene, dichloroethane, methylene chloride, etc.

The thickness of the charge transport layer 4 can be selected from a range of 5 to 30 $\mu$m according to the required properties of the photoreceptor.

Specific examples of plasticizers optionally added to the charge transport layer include plasticizers for general use for resins such as dibutylphthalate and dioctylphthalate. Suitable content of the plasticizer is from 0 to 30% by weight per 100% by weight of the binder resin.

Specific examples of leveling agents optionally added to the charge transport layer 4 include silicone oils such as dimethyl silicone oils and methyl phenyl silicone oils, and polymers or oligomers having a perfluoroalkyl group in the side chains. Suitable content of the leveling agent is from 0 to 1% by weight per 100% by weight of the binder resin.

The content of the charge transport material included in the photosensitive layer of the present invention is preferably not less than 40% by weight per 100% by weight of the charge transport layer. When the content is less than 40%, there is not enough damping time for the laser beam writing to the photoreceptor in a high-speed electrophotographic process.

The transportability of the charge transport layer of the photoreceptor of the present invention is preferably not less than $3\times10^{-5}$ $cm^2/V\cdot s$, and more preferably not less than $7\times10^{-5}$ $cm^2/V\cdot s$ under a condition of an electric filed strength of the charge transport layer ranging from $2.5\times10^5$ to $5.5\times10^5$ V/cm. The composition of the charge transport layer can be adjusted such that the transportability is within the range. The transportability can be measured by the known TOF method.

In the multilayer electrophotographic photoreceptor of the present invention, an undercoat layer can be formed between the substrate and the photosensitive layer.

The undercoat layer typically includes a resin as a main component. Considering that a photosensitive layer is coated on the undercoat layer with a solvent, the resin preferably has good resistance against a general organic solvent. Specific examples of such resins include water-soluble resins such as polyvinyl alcohol resins, casein and eiiipolyacrylic acid sodium; alcohol-soluble resins such as nylon copolymers and methoxymethylated nylon; and thermosetting resins forming a three-dimensional network such as polyurethane resins, melamine resins, alkyd-melamine resins and epoxy resins.

The undercoat layer may include a fine powder of metal oxides such as titanium oxides, silica, alumina, zirconium oxides, tin oxides and indium oxides to prevent occurrence of moire in the resultant images and to decrease the residual potential of the resultant photoreceptor. The undercoat layer can be formed using a suitable solvent and a suitable coating method just as the above-mentioned photosensitive layer can.

The undercoat layer may include a metal oxide formed by, for example, a sol-gel process and the like, using a silane coupling agent, a titanium coupling agent, a chromium coupling agent, etc.

In addition, a layer of aluminium oxide formed by anodic oxidation, a layer of an organic compound such as polyparaxylene (parylene) and an inorganic compound such as SiO, SnO2, TiO2, ITO or CeO2 formed by a vacuum thin film forming method can be also used as the undercoat layer.

The thickness of the undercoat layer is preferably from 0 to 5 $\mu$m.

A protective layer 5 including a filler is formed on the multilayer electrophotographic photoreceptor of the present invention as a surface layer to protect the photosensitive layer and to improve durability.

Specific examples of the materials for use in the protective layer 5 include resins such as ABS resins, ACS resins, olefin-vinyl monomer copolymers, chlorinated polyether resins, allyl resins, phenolic resins, polyacetal resins, polyamide resins, polyamideimide resins, polyacrylate resins, polyallylsulfone resins, polybutylene resins, polybutyleneterephthalate resins, polycarbonate resins, polyethersulfone resins, polyethylene resins, polyethyleneterephthalate resins, polyimide resins, acrylic resins, polymethylpentene resins, polypropylene resins, polyphenyleneoxide resins, polysulfone resins, AS resins, AB resins, BS resins, polyurethane resins, polyvinyl chloride resins, polyvinylidene chloride resins, and epoxy resins.

A filler is added to the protective layer 5 to also improve abrasion resistance.

Specific examples of such fillers include fine powders of fluorocarbon resins such as polytetrafluoroethylene; silicone resins; or inorganic materials such as titanium oxide, silica, alumina, zirconium oxide, tin oxide and potassium titanate.

The content of the filler added to the protective layer 5 is preferably from 10 to 40% by weight, and more preferably from 20 to 30% by weight. When the content of the filler is less than 10% by weight, abrasion resistance deteriorates. When the content is greater than 40% by weight, the potential of the lighted parts of the photoreceptor significantly increases and sensitivity deteriorates.

In addition, an auxiliary agent to improve the dispersibility of the filler can be added to the protective layer 5. Auxiliary agents used for paint, etc. can be used as the auxiliary agent. The content of the auxiliary agent is preferably from 0.5 to 4% by weight, and more preferably from 1 to 2% per 100% by weight of the filler.

In addition, the above-mentioned charge transport material can be added to the protective layer 5, and an antioxidant can be optionally added to the protective layer 5. The antioxidant will be explained later.

Known methods such as a spray coating method can be used to form the protection layer 5. The thickness of the protection layer is preferably from 0.5 to 10 $\mu$m, and more preferably from 4 to 6 $\mu$m.

In the present invention, it is important to uniformly disperse a filler in the protective layer such that the dispersed filler has the specific properties mentioned above to prepare a photoreceptor having good abrasion resistance and capable of producing images having good image properties. That is, the protective layer of the present invention does not deteriorate the sensitivity and the electrostatic stability of the photosensitive layer and it has high resolution properties relative to the imaging light. In addition, since the photoreceptor of the present invention has a thin protective layer having good abrasion resistance, high-resolution images can be produced at a high speed.

Forming a protective layer including inorganic fine particles on a photoreceptor considerably improves the abrasion resistance of the photoreceptor compared with an organic photoreceptor which does not have a protective layer. However, a photoreceptor having as high as possible abrasion-resistance is not always good in electrophotographic systems, and it is preferable to control the surface of a photoreceptor so as to be abraded very slightly to maintain good image properties.

It has been determined by the present inventors that the abrasion-resistance of the protective layer depends on the quantity of inorganic fine particles, i.e., the occupation ratio of the particles, and the particle diameter distribution thereof in any cross section of the protective layer. The occupation ratio is preferably from 3 to 5%, and the particle diameter distribution preferably has a peak at a diameter of from 0.2 to 0.3 $\mu$m.

As a result of the present inventors investigations, it has also been found that when the quantity of the filler (i.e., the inorganic fine particles) is small, the abrasion resistance is not good enough. In contrast, when the quantity is large, the residual potential increases, and the sensitivity of the resultant photoreceptor and the resolution of the resultant images deteriorate. The particle diameter distribution also influences the residual potential, and the sensitivity of the resultant photoreceptor and the resolution of the resultant images.

In addition, another important thing discussed by the inventors is that the occupation ratio of the particles of the filler having a particle diameter of not less than 0.3 $\mu$m in a cross section of the protective layer is from 10 to 30% of the total filler occupation area therein to prevent abnormal images such as image tailing. In addition, the surface of a photoreceptor can be abraded very slightly when the quantity of the filler having a particle diameter of not less than 0.3 $\mu$m is within the range mentioned above.

In this case, the particle diameter of a filler means the particle diameter of the primary particles and any secondary particles of the filler which are formed as an agglomeration of the primary particles. With a filler having a relatively large primary particle diameter, the filler is preferably dispersed so as to be almost all primary particles. However, agglomeration of the primary particles (i.e., the secondary particles) may be present in the protective layer. The particle diameter of the filler is determined including that of the secondary particles. The primary particles and the secondary particles can be present together in the protective layer.

The above mentioned preferable dispersion conditions of the filler in the protective layer can be controlled by controlling the following factors:

(1) particle diameter and the distribution of a material for use as the filler;

(2) formulation of a suitable coating liquid; and (3) coating apparatus and coating conditions.

Using a dispersant in the coating liquid is particularly effective because the dispersion of the filler in the protective layer is improved by adding the dispersant. Since adding too much dispersant causes an abnormal image, the amount added should be adjusted such that the above-mentioned desired dispersion conditions of the filler can be obtained.

In the present invention, the dispersion conditions of a filler are determined as follows:

(1) a part of the protective layer randomly selected is cut off;

(2) the cross section is treated so as to be electroconductive;

(3) the cross section is photographed using a field emission type scanning electron microscope;

(4) the cross section is scanned by an image scanner to be read by a personal computer;

(5) the particle diameter and the area of each filler in the cross section are determined using the Image Pro Plus image processing software manufactured by Media Cybernetics, L.P.; and (6) the dispersion conditions of the filler are determined from the distribution status of the filler in the cross section.

An intermediate layer can be formed between the photosensitive layer and the protective layer in the photoreceptor of the present invention.

A binder resin is typically used as a main component in the intermediate layer. Specific examples of binder resins include polyamide resins, alcohol-soluble nylon, water-soluble polyvinylbutyral resins, polyvinylbutyral resins, polyvinylalcohol resins, and the like. The above-mentioned conventional coating method can be used as a method for forming the intermediate layer. The thickness of the intermediate layer is preferably from 0.05 to 2 $\mu$m.

In the present invention, for an improvement of ambience, and above all, for the purpose of preventing the deterioration of the sensitivity and the increase of the residual potential of the photoreceptor, the following materials can be added to each layer of the photoreceptor:

(a) an antioxidant;

(b) a plasticizer;

(c) an ultraviolet absorbent;

(d) a low molecular weight charge transport material; and (e) a leveling agent.

Specific examples of the antioxidants (a) include phenolic compounds such as 2,6-di-t-butyl-p-cresol, butylated hydroxyanisole, 2,6-di-t-butyl-4-ethylphenol, n-octadecyl-3-3-(4-hydroxy-3,5-di-t-butylphenol), 2,2-methylene-bis-(4-methyl-6-t-butylphenol), 2,2-methylene-bis-(4-ethyl-6-t-butylphenol), 4,4-thiobis-(3-methyl-6-t-butylphenol), 4,4-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzil)benzene, tetrakis-[methylene-3-(3,5-di-t-butyl-4-hydroxyphenyl)propionate] methane, bis [3,3-bis(4-hydroxy-3-t-butylphenyl)butyric acid]glycol ester and tocopherol; paraphenylenediamine such as N-phenyl-N-isopropyl- p-phenylenediamine, N,N-di-sex-butyl-p-phenylenediamine, N-phenyl-N-sec-butyl-p-phenylenediamine, N,N-di-isopropyl-p-phenylenediamine, N,N-dimethyl-N, N-di-t-butyl-p- phenylenediamine; hydroquinone such as 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone; organic sulfuric compounds such as dilauryl-3,3-thiopropionate, distearyl-3,3-thiodipropionate and ditetradecyl-3,3-thiopropionate; and organic phosphoric compounds such as triphenylphosphine, tri(nonylphenyl) phosphine, tri(dinonylphenyl)phosphine, tricresylphosphine and tri(2,4-dibutylphenoxy)phosphine.

Specific examples of the plasticizers (b) include phosphoric acid ester plasticizers such as triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate and triphenyl phosphate; phthalic acid ester plasticizers such as dimethyl phthalate, diethyl phthalate, diisobutyl phthalate, dibutyl phthalate, diheptyl phthalate, di-2-ethylhexyl phthalate, diisobctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate and dioctyl fumarate; aromatic carboxylic acid ester plasticizers such as trioctyl trimellitate, tri-n-octyl trimellitate and octyl oxybenzoate; dibasic fatty acid ester plasticizers such as dibutyl adipate, di-n-hexyl adipate, di-2-ethylhexyl adipate, di-n-octyl adipate, n-octyl-n-decyl adipate, diisodecyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate and di-n-octyl tetrahydrophthalate; fatty acid ester derivative plasticizers such as butyl oleate, glycerin monooleate esters, methyl acetylricinolate, pentaerythritol esters, triacetin and tributyrin; oxyacid ester plasticizers such as methyl acetylricinolate, butyl acetylricinolate, butylphthalylbutyl glycolate and tributyl acetylcitrate; epoxy plasticizers such as epoxydized soybean oil, epoxydized linseed oil, butyl epoxystearate, decyl epoxystearate, octyl epoxystearate, benzyl epoxystearate, dioctyl epoxyhexahydrophthalate and didecyl epoxyhexahydrophthalate; dihydric alcohol ester plasticizers such as diethylene glycol dibenzoate and triethylene glycol di-2-ethylbutyrate; chlorine-containing plasticizers such as chlorinated paraffin, chlorinated diphenyl, methyl esters of chlorinated fatty acids and methyl esters of methoxychlorinated fatty acids; polyester plasticizers such as polypropylene adipate, polypropylene sebacate, polyesters and acetylated polyesters; sulfonic acid derivative plasticizers such as p-toluene sulfonamide, o-toluene sulfonamide, p-toluene sulfoneethylamide, o-toluene sulfoneethylamide, toluene sulfone-N-ethylamide and p-toluene sulfone-N-cyclohexylamide; citric acid derivative plasticizers such as triethyl citrate, triethyl acetylcitrate, tributyl citrate, tributyl acetylcitrate, tri-2-ethylhexyl acetylcitrate and n-octyldecyl acetylcitrate; and other compounds such as terphenyl, partially hydrated terphenyl, camphor, 2-nitro diphenyl, dinonyl naphthalene and methyl abietate.

Specific examples of the ultraviolet absorbents (c) include benzophenone ultraviolet absorbents such as 2-hydroxybenzophenone, 2,4-dihydroxybenzophenone, 2,2,4-trihydroxybenzophenone, 2,2,4,4-tetrahydroxybenzophenone and 2,2-dihydroxy4-methoxybenzophenone; salicylate ultraviolet absorbents such as phenyl salicylate and, 2,4-di-t-butylphenyl3,5-di-t-butyl4hydroxybenzoate; benzotriazole ultraviolet absorbents such as (2-hydroxyphenyl)benzotriazole, (2-hydroxy5-methylphenyl)benzotriazole, (2-hydroxy 5-methylphenyl9benzotriazole and (2-hydroxy3-t-butyl5-methlphenyl)5-chlorobenzotriazole; cyanoacrylate ultraviolet absorbents such as ethyl-2-cyano-3,3-diphenylacrylate and methyl2-carbomethoxy3(paramethoxy)acrylate; quencher (metal complex) ultraviolet absorbents such as nickel(2,2thiobis (4-t-octyl)phenolate)-n-butylamine, nickeldibutyldithiocarbamate and cobaltdicyclohexyldithiophosphate; and HALS (hindered amine) ultraviolet absorbents such as bis(2,2,6,6-tetramethyl-4-piperidyl)sebacate, bis(1,2,2,6,6-pentamethyl-4-piperidyl)sebacate, 1-[2-[3-(3, 5-di-t-butyl-4-hydroxyphenyl)propionyloxy]ethyl]-4-[3-(3,5-di-t-butyl-4-hydroxyphenyl)propionyloxy]-2,2,6,6-tetramethylpyridine, 8-benzyl-7,7,9,9-tetramethyl-3-octyl-1,3,8-triazaspiro[4,5]undecane-2,4-di-one and 4-benzoyloxy-2,2,6,6-tetramethylpiperidine.

The present invention provides an electrophotographic photoreceptor, in which (1) a photosensitive layer and a protective-layer are overlaid on an electroconductive substrate; (2) an undercoat layer and an intermediate layer are optionally formed between the-substrate and the photosensitive layer, and between the photosensitive layer and the protection layer, respectively; and (3) the. protective layer includes a filler to improve the abrasion resistance and the durability of the photoreceptor. The photoreceptor of the present invention has good durability, stability and abrasion resistance even when used in a high-speed electrophotographic apparatus since the filler in the protective layer is dispersed as mentioned above. In addition, by applying a lubricant to the surface of the protective layer, toner filming can be prevented while keeping the good abrasion resistance of the photoreceptor. In addition, it is preferable in the image forming apparatus of the present invention that repetition of an operation of toner adhesion to the photoreceptor and a collection operation of the toner at the cleaning portion when the toner image is not formed is effective to prevent an image tailing problem while hardly abrading the surface of the photoreceptor.

The toner of the present invention may include a lubricant. In addition, both a toner including a lubricant and a toner not including a lubricant may be used, and the toner including a lubricant has an effect on keeping the surface of the photoreceptor properly clean when the cleaning operation is performed.

Specific examples of the lubricants for use in the protective layer include fatty acid metal soap such as zinc stearate, zinc laurate, zinc myristate, calcium stearate and aluminium stearate; fine powders of fluorocarbon resins such as polytetrafluoroethylene, polyvinylidene fluoride and PFA; and fine powders of ethylene resins such as polyethylene and polypropylene. Zinc stearate and calcium stearate are preferably used.

When the quantity of the lubricant applied to the photoreceptor is too much, the quantity thereof on the transfer image also becomes too much, resulting in poor fixation of the transfer image. When the coefficient of friction of the photoreceptor falls to about 0.1 due to too much lubricant, the resultant image density deteriorates. For example, when a toner including zinc stearate is supplied to the surface of the photoreceptor, the content of the zinc stearate in the toner is preferably from 0.1 to 0.2% by weight.

In the image forming apparatus of the present invention, the toner adhesion to the photoreceptor and the toner collection at the cleaning portion when not producing an image prevent toner filming while maintaining abrasion resistance. In addition, adhesion and accumulation of a product on the photoreceptor caused by the charge thereon are prevented, because various materials adhered to the photoreceptor are cleaned together with the toner.

The toner adhesion and collection effectively operates when the adhered amount of the toner is suitable for a halftone image and the operating time is about 30 seconds, using a photoreceptor having a diameter of 30 mm and a linear velocity of 125 mm/sec. Using more toner and a longer operating time are not preferable because the cleaning portion is overloaded and the consumption of toner increases.

When the diameter and the linear velocity of the photoreceptor are different, the amount of the toner can be adjusted so as to be suitable for producing a halftone image.

As mentioned above, the thickness of the layers of the photoreceptor can be made thinner because of the improvement of the abrasion resistance thereof, which is preferable for producing an image having high resolution and is advantageous for an image forming apparatus.

In addition, the present invention provides an image forming method including at least a charging process, an image irradiation process, a developing process, a transfer process, a fixing process and a cleaning process, wherein the above-mentioned multilayer photoreceptor of the present invention is used.

Further, the present invention provides an image forming apparatus including at least a charger, an image irradiator, an image developer, a transferer, a fixer and a cleaner, wherein the above-mentioned multilayer photoreceptor of the present invention is used.

When the photosensitive layer is abraded, the electric properties of the photoreceptor such as chargeability and the capability of fading light change. Therefore, it becomes difficult to maintain the quality of the resultant image when predetermined processes are performed.

The photosensitive layer is abraded at all portions where the photoreceptor contacts other image forming units in an electrophotographic process. The unit causing the most abrasion is a cleaning unit such as a cleaning blade or a cleaning brush. The abrasion by the other units does not substantially affect the life of the photoreceptor.

The abrasion caused by the cleaning unit is typically separated into two patterns. One is the abrasion caused by the shearing force generated between the photoreceptor and the blade (or the brush), and the other is the abrasion caused by the toner which is sandwiched by the photoreceptor and the blade (or brush), and which performs like a grind stone.

It is found that a photoreceptor having good durability, stability and abrasion resistance is provided even when used in a high-speed electrophotographic process by forming a protective layer including a filler as a surface layer of the photoreceptor and by dispersing the filler in the protective layer as mentioned above.

Next, the image forming method and the image forming apparatus will be explained using the drawings.

Figure 3:
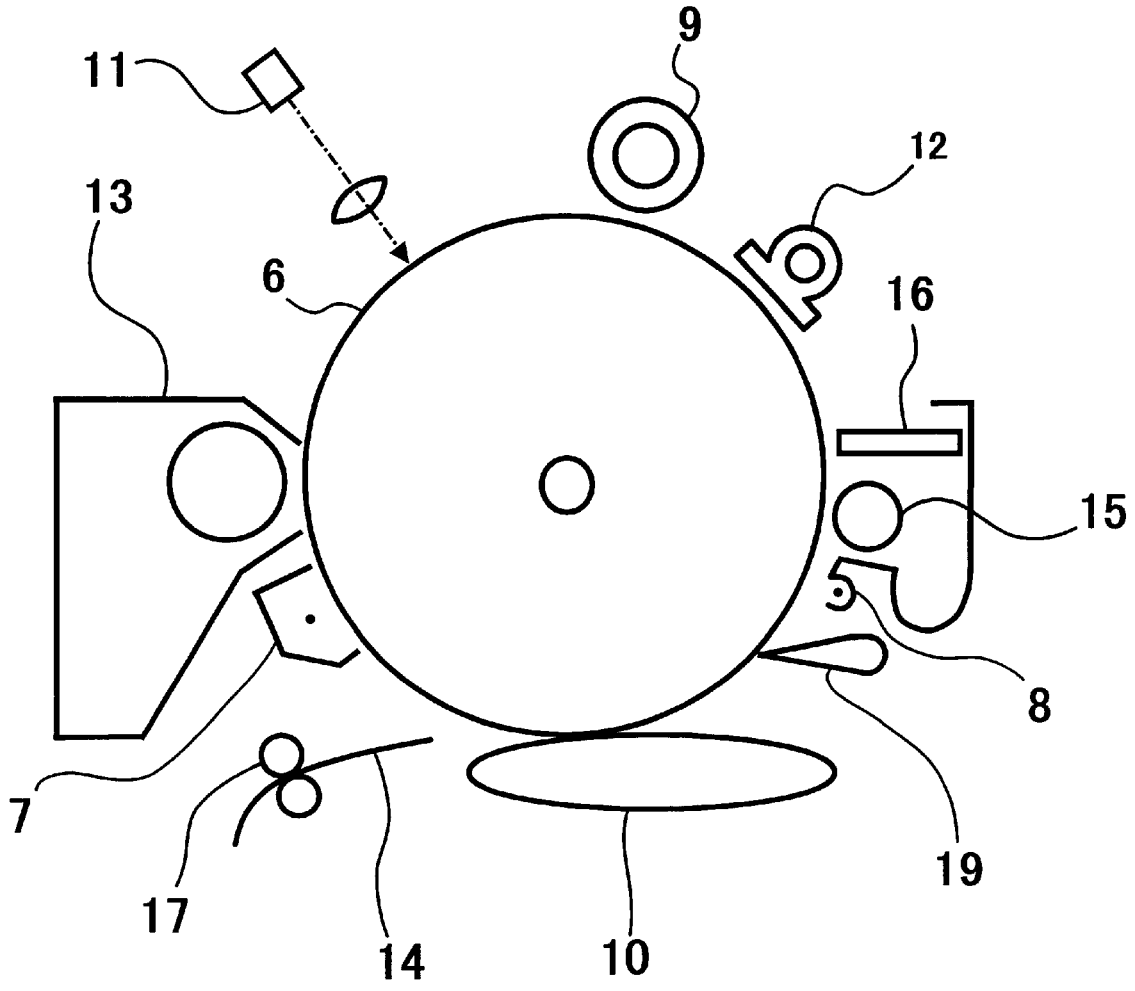
FIG. 3 is a schematic view illustrating an embodiment of the image forming method and the image forming apparatus of the present invention.

FIG. 3 is a schematic view illustrating an embodiment of the image forming method and the image forming apparatus of the present invention.

A photoreceptor 6 includes a photosensitive layer on an electroconductive substrate. The photoreceptor 6 is shown shaped like a drum, however, it can be shaped like a sheet or an endless belt.

A pre-transfer charger 7, a transfer charger, a separation charger and a pre-cleaning charger 8 are optionally arranged. Known chargers such as corotrons, scorotrons, solid state chargers and charging rollers are used therefor.

A charger 9 may contact the photoreceptor, however, it is preferable to arrange the charger 9 closely spaced relative to the photoreceptor such that a gap of from about 10 to 200 $\mu$m is formed therebetween to prevent the abrasion of both the photoreceptor and the charger as well as the toner filming problem. Particularly, by forming a gap of about 50 $\mu$m between the charger and the photoreceptor, good properties for the photoreceptor can be maintained. The reason is that the influence of the charging member on the surface of the protective layer can be minimized.

The voltage applied to the charger 9 is preferably a DC voltage overlapped with an AC voltage to stably perform charging in a manner to prevent uneven charging. However, even though the charge stability is good in this case, the surface layer of a standard photoreceptor tends to wear excessively as compared with the case in which only direct current is applied. The photoreceptor of the present invention can keep its good properties due to its high abrasion resistance even when a DC voltage overlapped with an AC voltage is applied to the charger.

As a transfer means, the above-mentioned chargers can be typically used, however, a transfer belt as shown in FIG. 3 is preferably used.

As a light source for an image irradiator 11, a discharging lamp 12 and the like, any known illuminators such as fluorescent lamps, tungsten lamps, halogen lamps, mercury lamps, sodium lamps, light emitting diodes (LEDs), laser diodes (LDs) and electroluminescense (EL) lamps can be used.

In order to irradiate with only light having a desired wavelength, various filters such as sharp cut filters, band pass filters, near infrared cutting filters, dichroic filters, interference filters and color temperature conversion filters can also be used.

Such light sources can also be used for a transfer process including light irradiation, a discharging process, a cleaning process or a pre-exposure process and the like process besides the processes shown in FIG. 3, to irradiate the photoreceptor 6.

A toner image developed on the photoreceptor 6 by a developing unit 13 is transferred to a transfer sheet 14. However, not all the toner is transferred and the residual toner on the photoreceptor 6 is removed by a fur blush 15 and a cleaning blade 16. The cleaning may be made by only the cleaning blush such as the fur blush and a mag-fur blush. When the photoreceptor 6 that is charged positively (or negatively) is exposed to imagewise light, an electrostatic latent image having a positive (or negative) charge is formed on the photoreceptor 6. When the latent image is developed with a toner having a negative (or positive) charge, a positive image can be obtained. In contrast, when the latent image is developed with a toner having a positive (negative) charge, a negative image can be obtained. Any known developing methods can be used. In addition, any known discharging methods can also be used. Numeral 17 denotes a registration roller, and numeral 19 denotes a separation pick.

The present invention provides an image forming method and an image forming apparatus using the electrophotographic photoreceptor of the present invention as an image bearing means. The image formation unit as shown in FIG. 3 can be fixedly built in a copier, a facsimile and a printer. In addition, the image formation unit may be built in each apparatus in the form of a detachable process cartridge.

Figure 4:
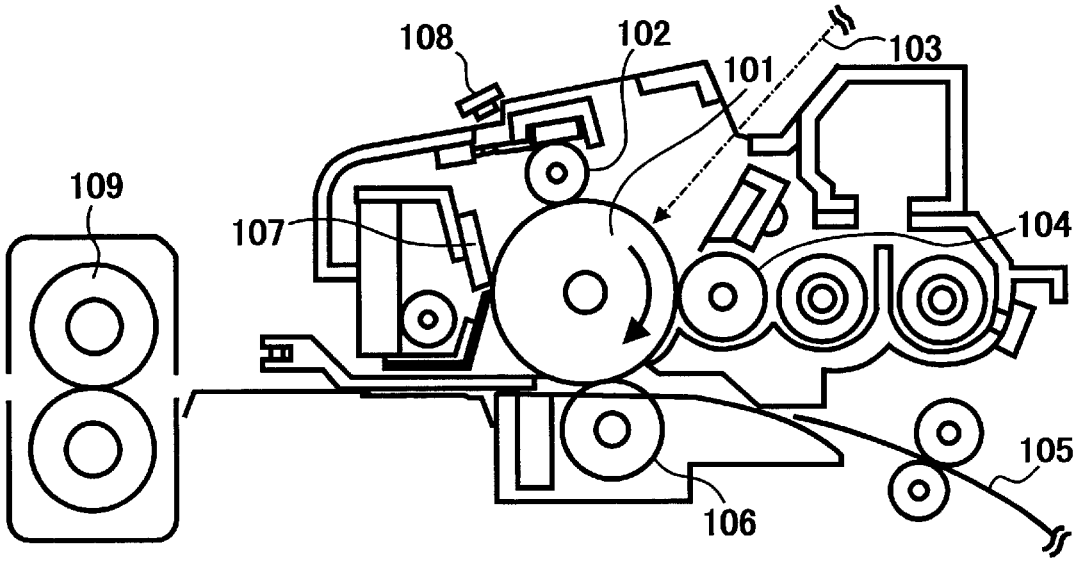
FIG. 4 is a schematic view illustrating an embodiment of the process cartridge for an image forming apparatus of the present invention.

FIG. 4 is a schematic view illustrating an embodiment of the process cartridge of the present invention for an image forming apparatus.

Numeral 101 denotes a photoreceptor drum rotating in a direction indicated by an arrow. Around the photoreceptor 101, a contact charger 102, an imagewise light irradiator 103, an image developer 104, a contact transfer device 106, a cleaning unit 107, a discharging lamp 108 and a fixer 109 are arranged, and a transfer sheet 105 is supplied thereto.

The process cartridge of the present invention includes at least a charge means, an irradiation means, a developing means, a transfer means, a cleaning means and a discharging means besides a photoreceptor. The photoreceptor 101 is the above-mentioned multilayer photoreceptor of the present invention.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat layer coating liquid, a charge generation layer coating liquid, a charge transport layer coating liquid and a protective layer coating liquid having the following components were coated and dried on an aluminium substrate in the order mentioned to prepare an electrophotographic photoreceptor having an under coat layer 3.5 μm thick, a charge generation layer 0.15 μm thick, a charge transport layer 20 μm thick and a protective layer 5 μm thick.

A spray coating method was used for coating the protective layer, and a dip coating method was used for coating the other layers.

| | |
|---|---|
| Undercoat layer coating liquid | |
| Powder of titanium dioxide | 400 |
| Melamine resin | 65 |
| Alkyd resin | 120 |
| 2-butanone | 400 |
| Charge generation layer coating liquid | |
| Titanyl phthalocyanine | 7 |
| Polyvinyl butyral | 5 |
| 2-butanone | 400 |
| Charge transport coating liquid | |
| Polycarbonate | 10 |
| Charge transport material having the following formula (1) | 8 |

(1)

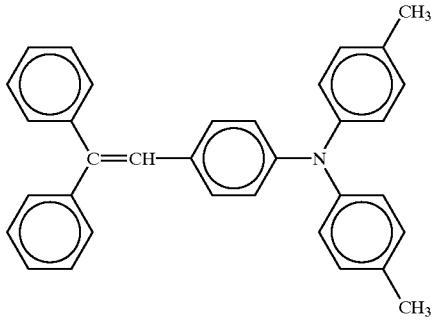

| | |
|---|---|
| Tetrahydrofuran | 200 |
| Protective layer coating liquid | |
| Polycarbonate | 10 |
| Charge transport material having the following formula (2) | 7 |

(2)

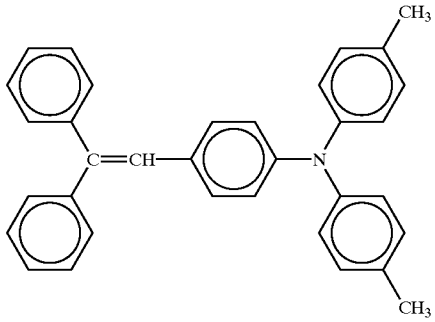

| | |
|---|---|
| Fine particles of alumina (AA-03 from Sumitomo Chemical Co., Ltd. having a particle diameter of 0.3 μm) | 6 |
| Dispersant (BYK-P104 from BYK Chemie Japan) | 0.08 |
| Tetrahydrofuran | 700 |
| Cyclohexanone | 200 |

The dispersant was added at the beginning of the mixing.

A random cross section of the protective layer of the thus prepared photoreceptor was observed by a scanning electron microscope (SEM) to investigate the dispersion conditions of the filler in the protective layer. The occupation ratio of the filler in the area was 3.3%.

The peak of the particle diameter distribution was 0.2 μm, and the occupation ratio of the filler having a particle diameter of not less than 0.3 μm was 16% of the total area of all the fillers.

In addition, an equivalent photoreceptor having a diameter of 30 mm was prepared to set in the electrophotographic process shown in FIG. 3, and its durability was evaluated. The imagewise light was that of a laser beam having a wavelength of 780 nm, and AC (2 kHz, 1.8 kvpp) and DC (−751V) were applied to the charging roller. The process speed was 125 mm/sec.

Example 3

The procedure for preparation and evaluation of the photoreceptor of Example 1 were repeated except that the charge generation coating liquid was changed to the following coating liquid and the parts by weight of the dispersant was changed to 0.07, and the laser beam was changed to a laser beam having a wavelength of 655 nm. Charge generation coating liquid

| | |
|---|---|
| Bisazo pigment having the following formula (4) | 12 |

(4)

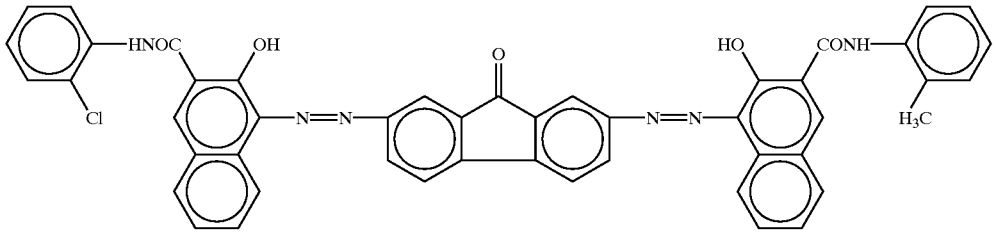

| | |
|---|---|
| Polyvinylbutyral | 5 |
| 2-butanone | 200 |
| Cyclohexanone | 400 |

The quality of the produced image was good at the beginning, and also good after 50,000 copies were continuously produced though a slight halftone image irregularity was observed. The abrasion loss of the photoreceptor after 50,000 copies were continuously produced was 1.9 μm.

Example 2

The procedure for preparation and evaluation of the photoreceptor of Example 1 were repeated except that the charge transport material used for coating the charge transport layer and the protective layer was changed to a material having the following formula (3).

(3)

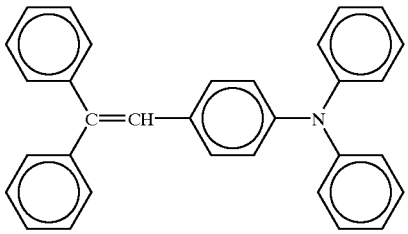

A random cross section of the protective layer of the thus prepared photoreceptor was observed by a SEM to investigate the dispersion conditions of the filler in the protective layer. The occupation ratio of the filler in the area was 4.6%.

The peak of the particle diameter distribution was 0.2 μm, and the occupation ratio of the filler having a particle diameter of not less than 0.3 μm was 12% of the total area of all the fillers.

The quality of the produced image was good at the beginning, and also good after 50,000 copies were continuously produced though a slight halftone image irregularity was observed. The abrasion loss of the photoreceptor after 50,000 copies were continuously produced was 2.2 μm.

A random cross section of the protective layer of the thus prepared photoreceptor was observed by a SEM to investigate the dispersion conditions of the filler in the protective layer. The occupation ratio of the filler in the area was 3.5%.

The peak of the particle diameter distribution was 0.3 μm, and the occupation ratio of the filler having a particle diameter of not less than 0.3 μm was 26% of the total area of all the fillers.

The quality of the produced image was good at the beginning, and also good after 50,000 copies were continuously produced though a slight halftone image irregularity was observed. The abrasion loss of the photoreceptor after 50,000 copies were continuously produced was 2.4 μm.

Comparative Example 1

The procedure for preparation and evaluation of the photoreceptor of Example 1 were repeated except that the dispersant was not used.

A random cross section of the protective layer of the thus prepared photoreceptor was observed by a SEM to investigate the dispersion conditions of the filler in the protective layer. The occupation ratio of the filler in the area was 3.7%.

The peak of the particle diameter distribution was 0.3 μm, and the occupation ratio of the filler having a particle diameter of not less than 0.3 μm was 43% of the total area of all the fillers.

The produced image gradually had black stripes due to a failure of cleaning after 50,000 copies were continuously produced. The abrasion loss of the photoreceptor after 50,000 copies were continuously produced was 2.5 μm.

Comparative Example 2

The procedure for preparation and evaluation of the photoreceptor of Example 2 were repeated except that the fine particles of alumina was changed to AA-07 from Sumitomo Chemical Co., Ltd. having a particle diameter of 0.7 μm .

A random cross section of the protective layer of the thus prepared photoreceptor was observed by a SEM to investigate the dispersion conditions of the filler in the protective layer. The occupation ratio of the filler in the area was 5.4%, and the peak of the particle diameter distribution was 0.6 μm .

The produced image gradually had black stripes due to a failure of cleaning after 50,000 copies were continuously produced. The abrasion loss of the photoreceptor after 50,000 copies were continuously produced was 1.8 μm.

Example 4

The procedure for preparation and evaluation of the electrophotographic process of Example 1 were repeated except that 0.15% by weight of a zinc stearate powder was added into the toner supplied to the developing part.

The produced image was very good and no halftone image irregularity was observed even after 50,000 copies were continuously produced. The abrasion loss of the photoreceptor after 50,000 copies were continuously produced was 1.4 μm.

Example 5

The procedure for preparation and evaluation of the electrophotographic process of Example 4 were repeated except that the following non-image forming performances were repeated for 20 sec. every time when 1,000 copies were produced through continuous production of 50,000 copies:

(1) light irradiation up to the lighted area potential;

(2) the toner image development; and (3) collection of the toner remaining on the photoreceptor by the cleaner.

The produced image was very good and no halftone image irregularity was observed even after 50,000 copies were continuously produced. The abrasion loss of the photoreceptor after 50,000 copies were continuously produced was 2.1 μm.

In addition, images were produced under the following environmental conditions of high temperature and high humidity after 50,000 copies were continuously produced. Temperature: 30° C. Humidity: 90% RH Deterioration of the image resolution due to image tailing was not observed.

Example 6

The procedure for preparation and evaluation of the electrophotographic process of Example 4 were repeated except that a pair of gap members made of a PET film of 50 μm thick having a width of 10 mm were formed on both sides of the charging roller in the non-image forming area such that the charging roller was arranged closely to the photoreceptor.

The produced image was very good and no halftone image irregularity was observed even after 50,000 copies were continuously produced. The abrasion loss of the photoreceptor after 50,000 copies were continuously produced was 1.3 μm .

At that time, residues such as toner components on the surface of the charging roller were hardly observed, and the initial condition of the roller was maintained. Therefore, the durability of the charging roller is effectively improved in the electrophotographic process of Example 6.

Example 7

The procedure for preparation and evaluation of the photoreceptor of Example 1 were repeated except that the fine particles of the alumina were changed to AA-04 from Sumitomo Chemical Co., Ltd. having a particle diameter of 0.4 μm.

A random cross section of the protective layer of the thus prepared photoreceptor was observed by a SEM to investigate the dispersion conditions of the filler in the protective layer. The occupation ratio of the filler in the area was 4.9%.

The peak of the particle diameter distribution was 0.3 μm, and the occupation ratio of the filler having a particle diameter of not less than 0.3 μm was 28% of the total area of all the fillers.

The quality of the produced image was good at the beginning, and also good after 50,000 copies were continuously produced though a slight halftone image irregularity was observed. The abrasion loss of the photoreceptor after 50,000 copies were continuously produced was 2.4 μm. Further, when images were produced under the environmental condition of 30° C. 90% RH after 50,000 copies were continuously produced, no image tailing was observed and the surface of the photoreceptor was kept clean.

Example 8

The procedure for preparation and evaluation of the photoreceptor of Example 1 were repeated except that the parts by weight of the adding volume of the dispersant was changed to 0.1.

A random cross section of the protective layer of the thus prepared photoreceptor was observed by a SEM to investigate the dispersion conditions of the filler in the protective layer. The occupation ratio of the filler in the area was 3.2%.

The peak of the particle diameter distribution was 0.2 μm, and the occupation ratio of the filler having a particle diameter of not less than 0.3 μm was 11% of the total area of all the fillers.

The quality of the produced image was good at the beginning, and also good after 50,000 copies were continuously produced though a slight halftone image irregularity was observed. The abrasion loss of the photoreceptor after 50,000 copies were continuously produced was 1.8 μm . Further, when images were produced under the environmental condition of 30° C. 90% RH after 50,000 copies were continuously produced, no image tailing was observed and the surface of the photoreceptor was kept clean.

Example 9

The procedure for preparation and evaluation of the photoreceptor of Example 3 were repeated except that the fine particles of the alumina were changed to AA-04 from Sumitomo Chemical Co., Ltd. having a particle diameter of 0.4 μm, and that the parts by weight of the adding volume of the dispersant was changed to 0.1.

A random cross section of the protective layer of the thus prepared photoreceptor was observed by a SEM to investigate the dispersion conditions of the filler in the protective layer. The occupation ratio of the filler in the area was 4.7%.

The peak of the particle diameter distribution was 0.3 μm, and the occupation ratio of the filler having a particle diameter of not less than 0.3 μm was 21% of the total area of all the fillers.

The quality of the produced image was good at the beginning, and also good after 50,000 copies were continuously produced though a slight halftone image irregularity was observed. The abrasion loss of the photoreceptor after 50,000 copies were continuously produced was 2.2 μm. Further, when images were produced under the environmental condition of 30° C. 90% RH after 50,000 copies were continuously produced, no image tailing was observed and the surface of the photoreceptor was kept clean.

Comparative Example 3

The procedure for preparation and evaluation of the photoreceptor of Example 4 were repeated except that the filler and the dispersant were not added to the protective layer of the photoreceptor.

The quality of the produced image was good at the beginning, but after 50,000 copies were continuously produced, a toner filming.occurred on the whole surface of the photoreceptor. Black stripes on the produced image and a big halftone image irregularity due to a failure of cleaning were observed. The abrasion loss of the photoreceptor after 50,000 copies were continuously produced was 4.6 μm. Further, when images were produced under the environmental condition of 30° C. 90% RH after 50,000 copies were continuously produced, image tailing was observed in every produced image.

Comparative Example 4

The procedure for preparation and evaluation of the photoreceptor of Example 9 were repeated except that the fine particles of the alumina were changed to silica fine particles from Shinetsu Chemical Co., Ltd. having a particle diameter of 0.1 μm.

A random cross section of the protective layer of the thus prepared photoreceptor was observed by a SEM to investigate the dispersion conditions of the filler in the protective layer. The occupation ratio of the filler in the area was 3.8%.

The peak of the particle diameter distribution was 0.1 μm, and the occupation ratio of the filler having a particle diameter of not less than 0.3 μm was 7% of the total area of all the fillers.

The quality of the produced image was good at the beginning, but after 50,000 copies were continuously produced, a halftone image irregularity was observed, which was believed to be caused by a residue on the surface of the photoreceptor. The abrasion loss of the photoreceptor after 50,000 copies were continuously produced was 2.1 μm. Further, when images were produced under the environmental condition of 30° C. 90% RH after 50,000 copies were continuously produced, deterioration of the image resolution due to image tailing was observed.

Example 10

The procedure for preparation and evaluation of the photoreceptor of Example 9 were repeated except that the parts by weight of the fine particles of the alumina for the protective layer coating liquid was changed to 5, and that the parts by weight of the adding volume of the dispersant was changed to 0.08.

A random cross section of the protective layer of the thus prepared photoreceptor was observed by a SEM to investigate the dispersion conditions of the filler in the protective layer. The occupation ratio of the filler in the area was 3.6%.

The peak of the particle diameter distribution was 0.3 μm, and the occupation ratio of the filler having a particle diameter of not less than 0.3 μm was 15% of the total area of all the fillers.

The quality of the produced image was good at the beginning, and also good after 50,000 copies were continuously produced though a slight halftone image irregularity was observed. The abrasion loss of the photoreceptor after 50,000 copies were continuously produced was 2.6 μm. Further, when images were produced under the environmental condition of 30° C. 90% RH after 50,000 copies were continuously produced, no image tailing was observed and the surface of the photoreceptor was kept clean.

Comparative Example 5

The procedure for preparation and evaluation of the photoreceptor of Example 9 were repeated except that the parts by weight of the fine particles of the alumina for the protective layer coating liquid was changed to 7.5 and that the parts by weight of the adding volume of the dispersant was changed to 0.12.

A random cross section of the protective layer of the thus prepared photoreceptor was observed by a SEM to investigate the dispersion conditions of the filler in the protective layer. The occupation ratio of the filler in the area was 6.0%.

The peak of the particle diameter distribution was 0.3 μm, and the occupation ratio of the filler having a particle diameter of not less than 0.3 μm was 19% of the total area of all the fillers.

The quality of the produced image was good at the beginning, and also good after 50,000 copies were continuously produced. However, when images were produced under the environmental condition of 30° C. 90% RH after 50,000 copies were continuously produced, image tailing was observed. The abrasion loss of the photoreceptor after 50,000 copies were continuously produced was 1.6 μm.

Comparative Example 6

The procedure for preparation and evaluation of the photoreceptor of Example 9 were repeated except that the parts by weight of the fine particles of the alumina for the protective layer coating liquid was changed to 4 and that the parts by weight of the adding volume of the dispersant was changed to 0.07.

A random cross section of the protective layer of the thus prepared photoreceptor was observed by a SEM to investigate the dispersion conditions of the filler in the protective layer. The occupation ratio of the filler in the area was 2.4%.

The peak of the particle diameter distribution was 0.3 μm, and the occupation ratio of the filler having a particle diameter of not less than 0.3 μm was 10% of the total area of all the fillers.

The quality of the produced image was good at the beginning, but after 50,000 copies were continuously produced, an apparent halftone image irregularity was observed. The abrasion loss of the photoreceptor after 50,000 copies were continuously produced was 4.1 μm.

Comparative Example 7

The procedure for preparation and evaluation of the photoreceptor of Example 10 were repeated except that the parts by weight of the adding volume of the dispersant was changed to 0.12.

A random cross section of the protective layer of the thus prepared photoreceptor was observed by a SEM to investigate the dispersion conditions of the filler in the protective layer. The occupation ratio of the filler in the area was 3.2%.

The peak of the particle diameter distribution was 0.3 μm, and the occupation ratio of the filler having a particle diameter of not less than 0.3 μm was 8% of the total area of all the fillers.

The quality of the produced image was good at the beginning, but after 50,000 copies were continuously produced, a halftone image irregularity was observed. When images were produced under the environmental condition of 30° C. 90% RH after 50,000 copies were continuously produced, image tailing was observed. The abrasion loss of the photoreceptor after 50,000 copies were continuously produced was 1.7 μm.

This document claims priority and contains subject matter related to Japanese Patent Applications Nos. 2000-342999, 2001-105675 and 2001-308556, filed on Nov. 10, 2000, Apr. 4, 2001 and Oct. 4, 2001 respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor comprising:

an electroconductive substrate; and a photosensitive layer located overlying the electroconductive substrate including,
a charge generation layer,
a charge transport layer, and
a protective layer comprising a filler, wherein content of the filler in the protective layer is from 10 to 40% by weight and the filler is dispersed in the protective layer such that in a cross section of the protective layer, the filler occupies an area of from 3 to 5% of the cross section,
wherein the filler has a particle diameter distribution having a peak at a diameter of from 0.2 to 0.3 μm, and
wherein particles of the filler having a particle diameter of not less than 0.3 μm occupy an area of from 10 to 30% of the area of the filler in the cross section of the protective layer.

2. An image forming method comprising:

charging a photoreceptor with a charger;

irradiating the photoreceptor with imagewise light to form an electrostatic latent image on the photoreceptor;

developing the electrostatic latent image with a toner to form a toner image on a surface of the photoreceptor;

transferring the toner image to a transfer sheet;

fixing the toner image on the transfer sheet; and cleaning the surface of the photoreceptor, wherein the photoreceptor comprises:
an electroconductive substrate; and
a photosensitive layer located overlying the electroconductive substrate including,
a charge generation layer,
a charge transport layer, and
a protective layer comprising a filler,
wherein content of the filler in the protective layer is from 10 to 40% by weight and the filler is dispersed in the protective layer such that in a cross section of the protective layer, the filler occupies an area of from 3 to 5% of the cross section,
wherein the filler has a particle diameter distribution having a peak at a diameter of from 0.2 to 0.3 μm, and
wherein particles of the filler having a particle diameter of not less than 0.3 μm occupy an area of from 10 to 30% of the area of the filler in the cross section of the protective layer.

3. The image forming method of claim 2, further comprising:

applying a lubricant on the surface of the photoreceptor.

4. The image forming method of claim 2, wherein the toner comprises a lubricant.

5. The image forming method of claim 2, wherein the cleaning step comprises:

adhering the toner onto the surface of the photoreceptor; and collecting the toner, and wherein, the cleaning step is performed at a time when the toner image is not formed.

6. The image forming method of claim 2, wherein the cleaning step comprises:

adhering a second toner comprising a lubricant onto the surface of the photoreceptor; and collecting the second toner, wherein the cleaning step is performed at a time when the toner image is not formed.

7. The image forming method of claim 2, wherein the charging step is performed while the charger contacts or is located in close proximity to the photoreceptor.

8. The image forming method of claim 2, wherein the charging step comprises:

applying a DC voltage overlapped with an AC voltage to the photoreceptor by the charger.

9. An image forming apparatus comprising:

a charger configured to charge a photoreceptor;

an image irradiator configured to irradiate the photoreceptor with imagewise light to form an electrostatic latent image on a surface of the photoreceptor;

an image developer configured to develop the electrostatic latent image with a toner to form a toner image on the photoreceptor;

a transferer configured to transfer the toner image to a transfer sheet;

a fixer configured to fix the toner image on the transfer sheet; and a cleaner configured to clean the surface of the photoreceptor, wherein the photoreceptor includes,
an electroconductive substrate, and
a photosensitive layer located overlying the electroconductive substrate including,
a charge generation layer,
a charge transport layer, and
a protective layer comprising a filler,
wherein content of the filler in the protective layer is from 10 to 40% by weight and the filler is dispersed in the protective layer such that in a cross section of the protective layer, the filler occupies an area of from 3 to 5% of the cross section,
wherein the filler has a particle diameter distribution having a peak at a diameter of from 0.2 to 0.3 μm, and
wherein particles of the filler having a particle diameter of not less than 0.3 μm occupy an area of from 10 to 30% of the area of the filler in the cross section of the protective layer.

10. The image forming apparatus of claim 9, wherein the toner comprises a lubricant.

11. The image forming apparatus of claim 10, wherein the image developer adheres the toner comprising a lubricant to the surface of the photoreceptor when the toner image is not formed, and wherein the cleaner collects the toner adhered on the surface of the photoreceptor.

12. The image forming apparatus of claim 9, further comprising:

a toner feeder configured to feed a second toner comprising a lubricant to the image developer.

13. The image forming apparatus of claim 12, wherein the image developer adheres the second toner fed by the toner feeder to the surface of the photoreceptor when the toner image is not formed, and wherein the cleaner collects the second toner adhered on the surface of the photoreceptor.

14. The image forming apparatus of claim 9, wherein the image developer adheres the toner to the surface of the photoreceptor when the toner image is not formed, and wherein the cleaner collects the toner adhered on the surface of the photoreceptor.

15. The image forming apparatus of claim 9, wherein the charger is one of a contact charger and a proximity charger configured to charge the photoreceptor while close to but not touching the surface of the photoreceptor.

16. The image forming apparatus of claim 9, wherein the charger is configured to charge the photoreceptor by applying a DC voltage overlapped with an AC voltage to the charging member.

17. A process cartridge comprising:

photoreceptor comprising a charge generation layer, a charge transport layer and a protective layer comprising a filler on an electroconductive substrate;

a charger configured to charge the photoreceptor;

an image irradiator configured to irradiate the photoreceptor with imagewise light to form an electrostatic latent image on the photoreceptor;

an image developer configured to irradiate the photoreceptor with imagewise light to form an electrostatic latent image on the photoreceptor;

an image developer configured to develop the electrostatic latent image with a toner to form a toner image on the photoreceptor;

a transferer configured to transfer the toner image to a transfer sheet; and a cleaner configured to clean the surface of the photoreceptor, wherein the photoreceptor includes an electroconductive substrate and a photosensitive layer located overlying the electroconductive substrate, and further comprising, a charge generation layer, a charge transport layer, and a protective layer comprising a filler, wherein the filler is dispersed in the protective layer such that in a cross section of the protective layer, the filler occupies an area of from 3 to 5% of the cross section, wherein content of the filler in the protective layer is from 10 to 40% by weight and the filler has a particle diameter distribution having a peak at a diameter of from 0.2 to 0.3 $\mu$m, and wherein particles of the filler having a particle diameter of not less than 0.3 $\mu$m, occupy an area of from 10 to 30% of the area of the filler in the cross section of the protective layer.

18. The process cartridge of claim 17, wherein the charger is one of a contact charger and a proximity charger configured to charge the photoreceptor while close to but not touching the surface of the photoreceptor.

19. The process cartridge of claim 17, wherein the charger is configured to charge the photoreceptor by applying a DC voltage overlapped with an AC voltage to the charging member.

20. The process cartridge of claim 17, wherein the toner comprises a lubricant.

21. The process cartridge of claim 20, wherein the image developer adheres the toner comprising a lubricant to the surface of the photoreceptor when the toner image is not formed, and wherein the cleaner collects the toner adhered on the surface of the photoreceptor.

22. The process cartridge of claim 17, further comprising:

a toner feeder configured to feed a second toner comprising a lubricant to the image developer.

23. The process cartridge of claim 22, wherein the image developer adheres the second toner fed by the toner feeder to the surface of the photoreceptor when the toner image is not formed and wherein the cleaner collects the second toner adhered on the surface of the photoreceptor.

24. The process cartridge of claim 17, wherein the image developer adheres the toner to the surface of the photoreceptor when the toner image is not formed, and wherein the cleaner collects the toner adhered on the surface of the photoreceptor.

* * * * *